US009708936B2

(12) United States Patent
Nagai et al.

(10) Patent No.: US 9,708,936 B2
(45) Date of Patent: Jul. 18, 2017

(54) CONDENSER

(71) Applicant: MITSUBISHI HITACHI POWER SYSTEMS, LTD., Kanagawa (JP)

(72) Inventors: Naonori Nagai, Tokyo (JP); Akira Fukui, Tokyo (JP); Satoshi Hiraoka, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 200 days.

(21) Appl. No.: 14/431,421

(22) PCT Filed: Oct. 7, 2013

(86) PCT No.: PCT/JP2013/077214
§ 371 (c)(1),
(2) Date: Mar. 26, 2015

(87) PCT Pub. No.: WO2014/057901
PCT Pub. Date: Apr. 17, 2014

(65) Prior Publication Data

US 2015/0252693 A1 Sep. 10, 2015

(30) Foreign Application Priority Data

Oct. 11, 2012 (JP) ..... 2012-225592

(51) Int. Cl.
*F01K 9/00* (2006.01)
*F28B 1/02* (2006.01)
*F28B 9/02* (2006.01)

(52) U.S. Cl.
CPC ..... *F01K 9/003* (2013.01); *F01K 9/00* (2013.01); *F28B 1/02* (2013.01); *F28B 9/02* (2013.01)

(58) Field of Classification Search
CPC ... F01K 9/00; F01K 11/00; F01K 7/44; F28B 1/01; F28B 9/02
See application file for complete search history.

(56) References Cited

U.S. PATENT DOCUMENTS

2010/0065253 A1 3/2010 Fujita et al.

FOREIGN PATENT DOCUMENTS

CN 1270300 A 10/2000
CN 201363970 Y 12/2009
(Continued)

OTHER PUBLICATIONS

English Translation JP 08158811 A.*
(Continued)

*Primary Examiner* — Mark Laurenzi
*Assistant Examiner* — Shafiq Mian
(74) *Attorney, Agent, or Firm* — Wenderoth, Lind & Ponack, L.L.P.

(57) ABSTRACT

The condenser which has a thin heat transfer pipe group, a main body trunk, and an intermediate trunk, and which generates condensed water by causing steam discharged from a steam turbine to flow from an upper section of the intermediate trunk, and by bringing the steam into contact with the thin heat transfer pipe group. In the intermediate trunk, upstream side heaters and downstream side heaters are arranged so as to be parallel to each other in a steam flowing direction. The downstream side heaters and turbine bypass pipes are arranged at the same position in the steam flowing direction. The length of a gap between the upstream side heaters and the downstream side heaters, and the turbine bypass pipes is set to be equal to or shorter than the radius of the turbine bypass pipes.

5 Claims, 4 Drawing Sheets

(56) References Cited

FOREIGN PATENT DOCUMENTS

| | | | |
|---|---|---|---|
| JP | 61-215406 | | 9/1986 |
| JP | 63-73004 | | 4/1988 |
| JP | 63-186907 | | 11/1988 |
| JP | 64-019002 | | 1/1989 |
| JP | 7-151475 | | 6/1995 |
| JP | 7-174888 | | 7/1995 |
| JP | 8-135404 | | 5/1996 |
| JP | 8-158811 | | 6/1996 |
| JP | 08158811 A | * | 6/1996 |
| JP | 11-325751 | | 11/1999 |
| JP | 2001-153569 | | 6/2001 |
| JP | 2002-243386 | | 8/2002 |
| JP | 2003-014381 | | 1/2003 |
| JP | 3590661 | | 11/2004 |
| WO | 99/51858 | | 10/1999 |

OTHER PUBLICATIONS

Office Action issued Feb. 23, 2016 in corresponding Japanese Patent Application No. 2014-540836 (with English translation).
International Search Report issued Nov. 5, 2013 in corresponding International Application No. PCT/JP2013/077214 (with English translation).
Written Opinion issued Nov. 5, 2013 in corresponding International Application No. PCT/JP2013/077214 (with English translation).
Office Action issued Aug. 31, 2015 in Chinese Application No. 201380049907.0 (with English translation of Search Report).
Office Action issued Sep. 29, 2015 in German Application No. 112013004969.4 (with English translation).

* cited by examiner

CONDENSER

TECHNICAL FIELD

The present invention relates to a condenser which generates condensed water by cooling and condensing steam discharged from a steam turbine by means of heat exchange. Priority is claimed on Japanese Patent Application No. 2012-225592, filed Oct. 11, 2012, the content of which is incorporated herein by reference.

BACKGROUND ART

In general, in a steam turbine power plant, steam obtained by a steam generator is supplied to a steam turbine, thereby driving the steam turbine and generating power. The steam having completed the task in the steam turbine is condensed by a condenser so as to generate condensed water. Thereafter, the condensed water is returned to the steam generator side. That is, in the steam turbine power plant, thermal efficiency of the plant is improved by causing the steam discharged from the steam turbine to flow into the condenser and by recovering thermal energy belonging to the steam.

In addition, the condenser internally has a thin heat transfer pipe group which is configured to have multiple thin heat transfer pipes and into which a cooling medium is circulated. The steam flowing into the condenser is cooled and condensed by the thin heat transfer pipe group, thereby generating the condensed water. In this case, internal structural members such as a heater, a pipe, and a reinforcing plate are arranged on an upstream side in a steam flowing direction of the steam flowing into the condenser. Therefore, the steam flowing into the condenser flows toward the thin heat transfer pipe group while passing through the internal structural members.

However, the internal structural members arranged inside the condenser become fluid resistance to the steam flowing toward the thin heat transfer pipe group, thereby disturbing the flow of the steam. As a result, there is a possibility of decreased condensation efficiency in the condenser.

In addition, a turbine exhaust stream (flow of the steam) passing through the pipe and containing fine droplets flows toward the thin heat transfer pipe with constant distribution, and is subjected to heat exchange using convection flow. However, depending on the distribution of the flow of the steam and an arrangement of the thin heat transfer pipe, the droplets collide with the thin heat transfer pipe at a high flow rate. As a result, droplet erosion occurs, thereby causing a possibility that the thin heat transfer pipe may be corroded.

In addition, when heat exchange efficiency is considered, a temperature difference between a surface of the thin heat transfer pipe and bulk fluid becomes important. However, there is a possibility that temperature distribution on the fluid side may not be considered.

Therefore, in the related art, various types of the condenser are provided which aim to improve the condensation efficiency by improving the flow of the steam. For example, Patent Document 1 and Patent Document 2: disclose this condenser in the related art.

PRIOR ART DOCUMENT

Patent Document

Patent Document 1: Japanese Unexamined Patent Application, First Publication No. 2003-14381

Patent Document 2: Japanese Unexamined Patent Application, First Publication No. H11-325751

SUMMARY OF INVENTION

Technical Problem

In the condenser in the related art which is disclosed in Patent Document 1 described above, a flow straightening plate is disposed around the heater in order to improve the flow of the steam. However, as described above, the internal structural members arranged inside the condenser include not only the heater but also the pipe and the reinforcing plate. In particular, it is very difficult to appropriately dispose the flow straightening plate in a complicated pipe system. Thus, even when the configuration of the condenser in the related art is adopted, a flow straightening effect using the flow straightening plate cannot be sufficiently obtained. Therefore, there is a possibility that the flocculating efficiency cannot be improved.

In addition, in the condenser disclosed in Patent Document 2 described above, a baffle plate and a protection pipe for protecting the thin heat transfer pipe are disposed outside the pipe (bypass steam injection pipe) so as to handle a large amount of turbine bypass steam without increasing pressure loss during a normal operation. However, according to the condenser disclosed in Patent Document 2 described above, although the flow of the turbine exhaust stream is controlled, there is a possibility that the heat exchange efficiency cannot be improved.

A first object of the present invention is to provide a condenser which can improve condensation efficiency by appropriately setting a position for installing internal structural members and by controlling flow of steam flowing into the condenser.

In addition, a second object of the present invention is to provide a condenser which can improve condensation efficiency by appropriately setting a position for installing internal structural members, by preventing droplet erosion, and by improving heat exchange efficiency.

Technical Solution

According to a first aspect of the present invention, there is provided a condenser which has a heat transfer pipe for circulating a cooling medium, a bottom section for arranging the heat transfer pipe, and a trunk section for communicating with the bottom section, and which generates condensed water by causing steam discharged from a steam turbine to flow into the bottom section from an upper section of the trunk section, by bringing the steam into contact with the heat transfer pipe, and by condensing the steam. The condenser includes a first upstream side heater and a second upstream side heater which are arranged so as to be orthogonal to a steam flowing direction, in the trunk section, a first downstream side heater and a second downstream side heater which are arranged so as to be located on a downstream side in the steam flowing direction from the first and second upstream side heaters, and so as to be parallel to the first and second upstream side heaters, in the trunk section, a first turbine bypass pipe and a second turbine bypass pipe which supply the steam bypassing the steam turbine into the trunk section, the first turbine bypass pipe and the second turbine bypass pipe which is arranged so as to be parallel to the first and second upstream side heaters and the first and second downstream side heaters, and by being arranged outside in a trunk width direction of the first and second upstream side heaters and the first and second downstream side heaters, based on the trunk width direction orthogonal to the steam flowing direction, in the trunk section, and a first steam extraction pipe and a second steam extraction pipe which supply the steam to the first and second upstream side heaters and the first and second downstream side heaters by extracting the steam discharged from the steam turbine, the first steam extraction pipe and the second steam extraction pipe which is arranged so as to be parallel to the first and second upstream side heaters and the first and second downstream side heaters.

The first downstream side heater and the first turbine bypass pipe are arranged at the same position in the steam flowing direction, the length of a gap between the first downstream side heater and the first turbine bypass pipe being set to be equal to or shorter than the radius of the first turbine bypass pipe. The second downstream side heater and the second turbine bypass pipe are arranged at the same position in the steam flowing direction, the length of a gap between the second downstream side heater and the second turbine bypass pipe being set to be equal to or shorter than the radius of the second turbine bypass pipe.

The condenser can control the flow of the steam flowing into the condenser by the position for installing the upstream side heater, the downstream side heater, and the turbine bypass pipe being appropriately set.

According to a second aspect of the present invention, the first and second steam extraction pipes are arranged outside in the trunk width direction of the first and second turbine bypass pipes.

According to a third aspect of the present invention, the first steam extraction pipe is arranged between the first upstream side heater, and the first downstream side heater and the first turbine bypass pipe in the steam flowing direction, and is arranged between the first upstream side heater and the first downstream side heater, and the first turbine bypass pipe in the trunk width direction. The second steam extraction pipe is arranged between the second upstream side heater, and the second downstream side heater and the second turbine bypass pipe in the steam flowing direction, and is arranged between the second upstream side heater and the second downstream side heater, and the second turbine bypass pipe in the trunk width direction.

The condenser can control the flow of the steam flowing into the condenser by the position for installing the steam extraction pipe and the turbine bypass pipe being appropriately set.

According to a fourth aspect of the present invention, the condenser further includes a first cover section which is arranged inside the bottom section so as to cover the heat transfer pipe from an upstream side in the steam flowing direction, and which has multiple first communication portions communicating with the steam flowing direction.

The condenser can prevent droplets from directly colliding with the heat transfer pipe, since an upstream side surface of the heat transfer pipe is covered with the first cover section having the multiple first communication portions. In this manner, it is possible to prevent droplet erosion from occurring. In addition, the flow of the steam can be straightened since the steam passes through the first communication portions.

According to a fifth aspect of the present invention, the condenser according to the fourth aspect further includes a second cover section which is arranged inside the bottom section so as to extend from the first cover section in the steam flowing direction and so as to cover the heat transfer pipe in a direction intersecting the steam flowing direction, and which has multiple second communication portions communicating with the direction intersecting the steam flowing direction.

Since the heat transfer pipe is covered with the second cover section in the direction intersecting the steam flowing direction, the condenser can guide the steam to the heat transfer pipe by causing the steam to flow into the multiple second communication portions. In this manner, since a suitable temperature gradient is formed around the heat transfer pipe, it is possible to promote an advantageous effect of transferring heat from the steam to the heat transfer pipe.

According to a sixth aspect of the present invention, there is provided a condenser which has a heat transfer pipe for circulating a cooling medium, a bottom section for arranging the heat transfer pipe, and a trunk section for communicating with the bottom section, and which generates condensed water by causing steam discharged from a steam turbine to flow into the bottom section from an upper section of the trunk section, by bringing the steam into contact with the heat transfer pipe, and by condensing the steam. The condenser includes a first cover section which is arranged inside the bottom section so as to cover the heat transfer pipe from an upstream side in a steam flowing direction, and which has multiple first communication portions communicating with the steam flowing direction.

The condenser can prevent droplets from directly colliding with the heat transfer pipe, since an upstream side surface of the heat transfer pipe is covered with the first cover section having the multiple first communication portions. In this manner, it is possible to prevent droplet erosion from occurring. In addition, the flow of the steam can be straightened since the steam passes through the first communication portions.

According to a seventh aspect of the present invention, there is provided a condenser which has a heat transfer pipe for circulating a cooling medium, a bottom section for arranging the heat transfer pipe, and a trunk section for communicating with the bottom section, and which generates condensed water by causing steam discharged from a steam turbine to flow into the bottom section from an upper section of the trunk section, by bringing the steam into contact with the heat transfer pipe, and by condensing the steam. The condenser includes a first cover section which is arranged inside the bottom section so as to cover the heat transfer pipe from an upstream side in a steam flowing direction, and which has multiple first communication portions communicating with the steam flowing direction, and a second cover section which is arranged inside the bottom section so as to extend from the first cover section in the steam flowing direction and so as to cover the heat transfer pipe in a direction intersecting the steam flowing direction, and which has multiple second communication portions communicating with the direction intersecting the steam flowing direction.

The condenser can prevent droplets from directly colliding with the heat transfer pipe, since an upstream side surface of the heat transfer pipe is covered with the first cover section having the multiple first communication portions. In this manner, it is possible to prevent droplet erosion from occurring. In addition, the flow of the steam can be straightened since the steam passes through the first communication portions. Furthermore, since the heat transfer pipe is covered with the second cover section in the direction intersecting the steam flowing direction, the condenser can guide the steam to the heat transfer pipe by causing the steam to flow into the multiple second communication portions. In this manner, since a suitable temperature gradient is formed around the heat transfer pipe, it is possible to promote an advantageous effect of transferring heat from the steam to the heat transfer pipe.

Advantageous Effects

According to the above-described condenser, it is possible to control the flow of the steam flowing into the condenser by appropriately setting the position for installing the upstream side heater, the downstream side heater, and the turbine bypass pipe. Therefore, it is possible to improve condensation efficiency.

In addition, according to the above-described condenser, since the upstream side surface of the heat transfer pipe is covered with the first cover section having the multiple first communication portions, it is possible to prevent droplet erosion from occurring, and thus it is possible to prevent damage to the heat transfer pipe. In addition, since the first cover section is arranged on the upstream side in the steam flowing direction from the heat transfer pipe, the flow of the steam can be straightened. Therefore, it is possible to improve condensation efficiency.

In addition, according to the above-described condenser, since the heat transfer pipe is covered with the second cover section in the direction intersecting the steam flowing direction, it is possible to promote a heat transfer effect by causing the steam to flow into the multiple second communication portions and by allowing a suitable temperature gradient. As a result, it is possible to improve condensation efficiency.

DESCRIPTION OF EMBODIMENTS

Hereinafter, a condenser according to embodiments of the present invention will be described in detail with reference to the drawings.

Figure 1:
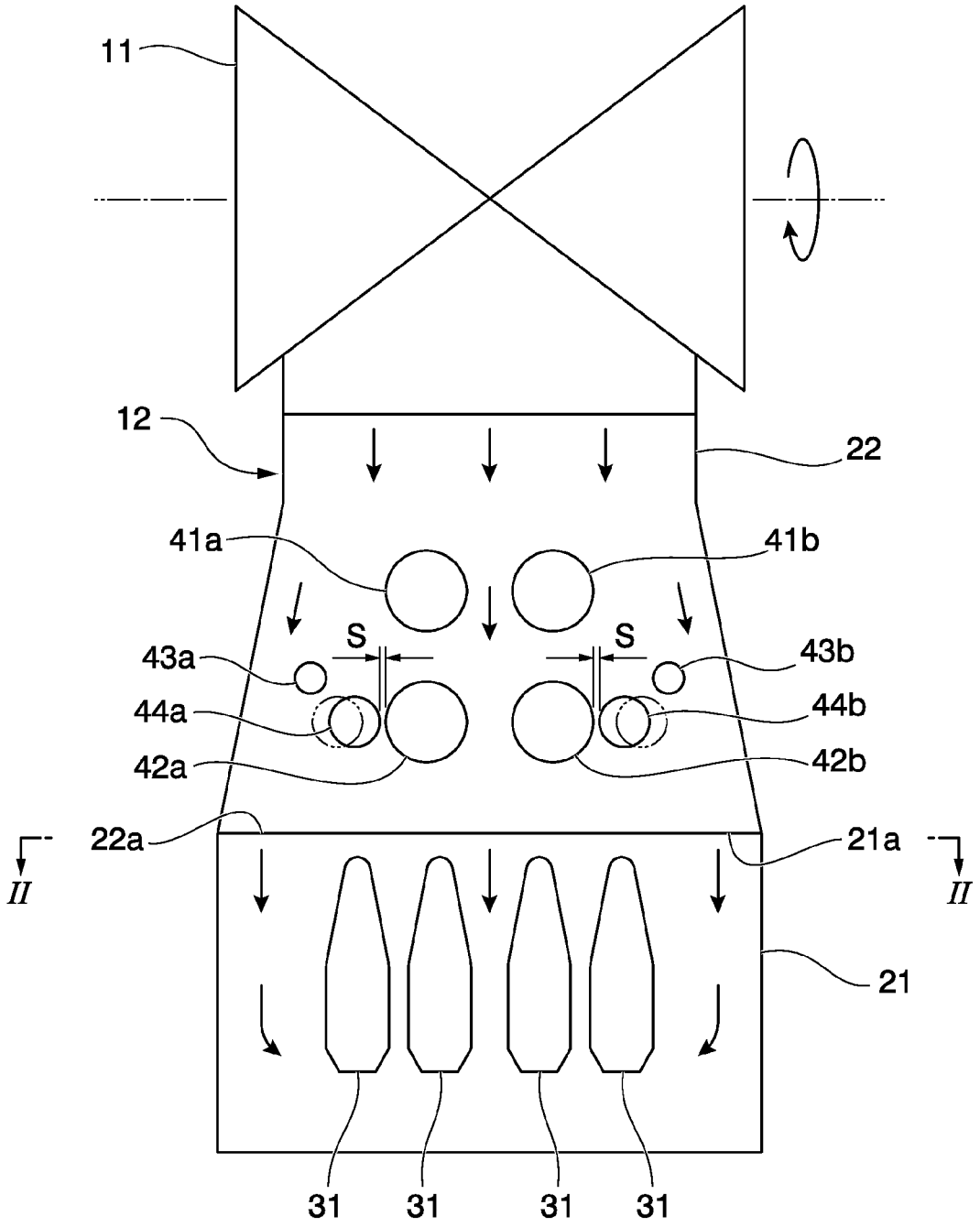
FIG. 1 is a schematic configuration view of a condenser according to a first embodiment of the present invention.

As shown in FIG. 1, a steam turbine power plant (not shown) has a steam turbine 11 and a condenser 12 which communicates with a lower section of the steam turbine 11.

A steam generator (not shown) such as boiler and a nuclear reactor is connected to the steam turbine 11. High temperature and high pressure steam generated by the steam generator can be supplied to the steam turbine 11. If the steam is supplied to the steam turbine 11, the steam turbine 11 is rotated so as to drive a generator (not shown). At the same time, the steam having completed the task in the steam turbine 11 flows into the condenser 12. The arrow shown in the drawing represents the flow of the steam.

In addition, the condenser 12 is configured to include a main body trunk 21 (bottom section) arranged in a lower section of the condenser 12 and an intermediate trunk 22 (trunk section) arranged between an upper section of the main body trunk 21 and a lower section of the steam turbine 11. That is, an upper end inlet 21*a* of the main body trunk 21 and a lower end outlet 22*a* of the intermediate trunk 22 communicate with each other.

Four thin heat transfer pipe groups 31 (heat transfer pipe) configured to have multiple thin heat transfer pipes are disposed in a region of the bottom section of the main body trunk 21. These thin heat transfer pipe groups 31 are arranged so as to be parallel to each other in a direction orthogonal to an axial direction (rotation axis direction) of the steam turbine 11. A coolant is circulated inside the thin heat transfer pipe configuring the thin heat transfer pipe group 31.

That is, if the steam flowing into the main body trunk 21 comes into contact with the thin heat transfer pipe group 31, heat exchange is performed between the steam and the coolant so as to condense the steam, thereby generating condensed water. The generated condensed water is reserved in the bottom section of the main body trunk 21 for the time being, and then, is supplied to the steam generator side.

In contrast, a pair of upstream side heaters configured to have a first upstream side heater 41*a* and a second upstream side heater 41*b* and a pair of downstream side heaters configured to have a first downstream side heater 42*a* and a second downstream side heater 42*b* are arranged inside the intermediate trunk 22 in a direction orthogonal to the axial direction of the steam turbine 11. The upstream side heaters 41*a* and 41*b* and the downstream side heaters 42*a* and 42*b* are feed water heaters which pre-heat the condensed water before being supplied to the steam generator side by using the steam extracted from the steam turbine 11, and can come into contact with the condensed water discharged from the bottom section of the main body trunk 21.

A gap (inter-axis distance) in the trunk width direction between the upstream side heaters 41*a* and 41*b* has the same length as a gap (inter-axis distance) in the trunk width direction between the downstream side heaters 42*a* and 42*b*. Similarly, a gap (inter-axis distance) in the steam flowing direction between the first upstream side heaters 41*a* and the first downstream side heater 42*a* has the same length as a gap (inter-axis distance) in the steam flowing direction between the second upstream side heater 41*b* and the second downstream side heater 42*b*. That is, the upstream side heaters 41*a* and 41*b* and the downstream side heaters 42*a* and 42*b* are arranged so as to be parallel to each other in the steam flowing direction in the intermediate trunk 22.

In addition, a pair of steam extraction pipes configured to have a first steam extraction pipe 43*a* and a second steam extraction pipe 43*b* is arranged in a direction orthogonal to the axial direction of the steam turbine 11, outside in the trunk width direction of the intermediate trunk 22 from a heater group having a group of the upstream side heaters 41*a* and 41*b* and the downstream side heaters 42*a* and 42*b*. These steam extraction pipes 43*a* and 43*b* are formed so as to have a smaller diameter than the upstream side heaters 41*a* and 41*b* and the downstream side heaters 42*a* and 42*b*, and respectively extract the steam extracted from the steam turbine 11 and supply it to the downstream side heaters 42*a* and 42*b*.

Steam extraction pipes which supply the steam to the upstream side heaters 41*a* and 41*b* are omitted in the illustration.

The first steam extraction pipe 43*a* is arranged on the downstream side in the steam flowing direction of the first upstream side heater 41*a* and on the upstream side in the steam flowing direction of the first downstream side heater 42*a*, between an inner surface of the intermediate trunk 22, and the first upstream side heater 41*a* and the first downstream side heater 42*a*. In contrast, the second steam extraction pipe 43*b* is arranged on the downstream side in the steam flowing direction of the second upstream side heater 41*b* and on the upstream side in the steam flowing direction of the second downstream side heater 42*b*, between the inner surface of the intermediate trunk 22, and the second upstream side heater 41*b* and the second downstream side heater 42*b*.

Furthermore, a pair of turbine bypass pipes configured to have a first turbine bypass pipe 44*a* and a second turbine bypass pipe 44*b* is arranged in a direction orthogonal to the axial direction of the steam turbine 11, outside in the trunk width direction of the first downstream side heater 42*a* and the second downstream side heater 42*b*. These turbine bypass pipes 44*a* and 44*b* connect the steam generator and the condenser 12 to each other, and directly supply the steam generated by the steam generator into the intermediate trunk 22 by bypassing the steam turbine 11.

The first turbine bypass pipe 44*a* has the same axial height as the first downstream side heater 42*a* in the steam flowing direction, and is arranged between the first downstream side heater 42*a* and the first steam extraction pipe 43*a* in the trunk width direction. In contrast, the second turbine bypass pipe 44*b* has the same axial height as the second downstream side heater 42*b* in the steam flowing direction, and is arranged between the second downstream side heater 42*b* and the second steam extraction pipe 43*b* in the trunk width direction.

The turbine bypass pipes 44*a* and 44*b* are formed to have a smaller diameter than the upstream side heaters 41*a* and 41*b* and the downstream side heaters 42*a* and 42*b*, and are formed to have a larger diameter than the steam extraction pipes 43*a* and 43*b*. In addition, the upstream side heaters 41*a* and 41*b*, the downstream side heaters 42*a* and 42*b*, the steam extraction pipes 43*a* and 43*b*, and the turbine bypass pipes 44*a* and 44*b* are members configuring internal structural members arranged inside the condenser 12.

First Embodiment

In the condenser 12 according to a first embodiment, an installation position for the turbine bypass pipes 44*a* and 44*b* is moved inward in the trunk width direction as compared to the installation position in the related art (position shown by a two-dot chain line in FIG. 1). A gap (inter-axis distance) S between the first downstream side heater 42*a* and the first turbine bypass pipe 44*a* and a gap (inter-axis distance) S between the second downstream side heater 42*b* and the second turbine bypass pipe 44*b* are decreased (shortened), thereby controlling the flow of the steam flowing into the condenser 12. Specifically, the length of the above-described gap S is set to be equal to or shorter than the radius of the turbine bypass pipes 44*a* and 44*b*.

Accordingly, the steam discharged from the steam turbine 11 flows therein from an upper section of the intermediate trunk 22, and passes through respective gaps in the upstream side heaters 41*a* and 41*b*, the downstream side heaters 42*a* and 42*b*, the steam extraction pipes 43*a* and 43*b*, and the turbine bypass pipes 44*a* and 44*b*. Thereafter, the steam flows toward the thin heat transfer pipe group 31 disposed in the main body trunk 21.

In this case, the gaps S between the downstream side heaters 42*a* and 42*b* and the turbine bypass pipes 44*a* and 44*b* are decreased, thereby decreasing a flow rate of the steam passing through the gaps S. The flow rate of the steam passing through a portion between the downstream side heaters 42*a* and 42*b* and the flow rate of the steam flowing along the inner surface of the intermediate trunk 22 increase that much.

In this manner, flow rate distribution of the steam substantially corresponds to flow velocity distribution. Therefore, the flow velocity distribution of the steam in the upper end inlet 21*a* (lower end outlet 22*a* of the intermediate trunk 22) of the main body trunk 21 located on the upstream side in the steam flowing direction from the thin heat transfer pipe group 31 is shown as shown in FIG. 2.

Figure 2:
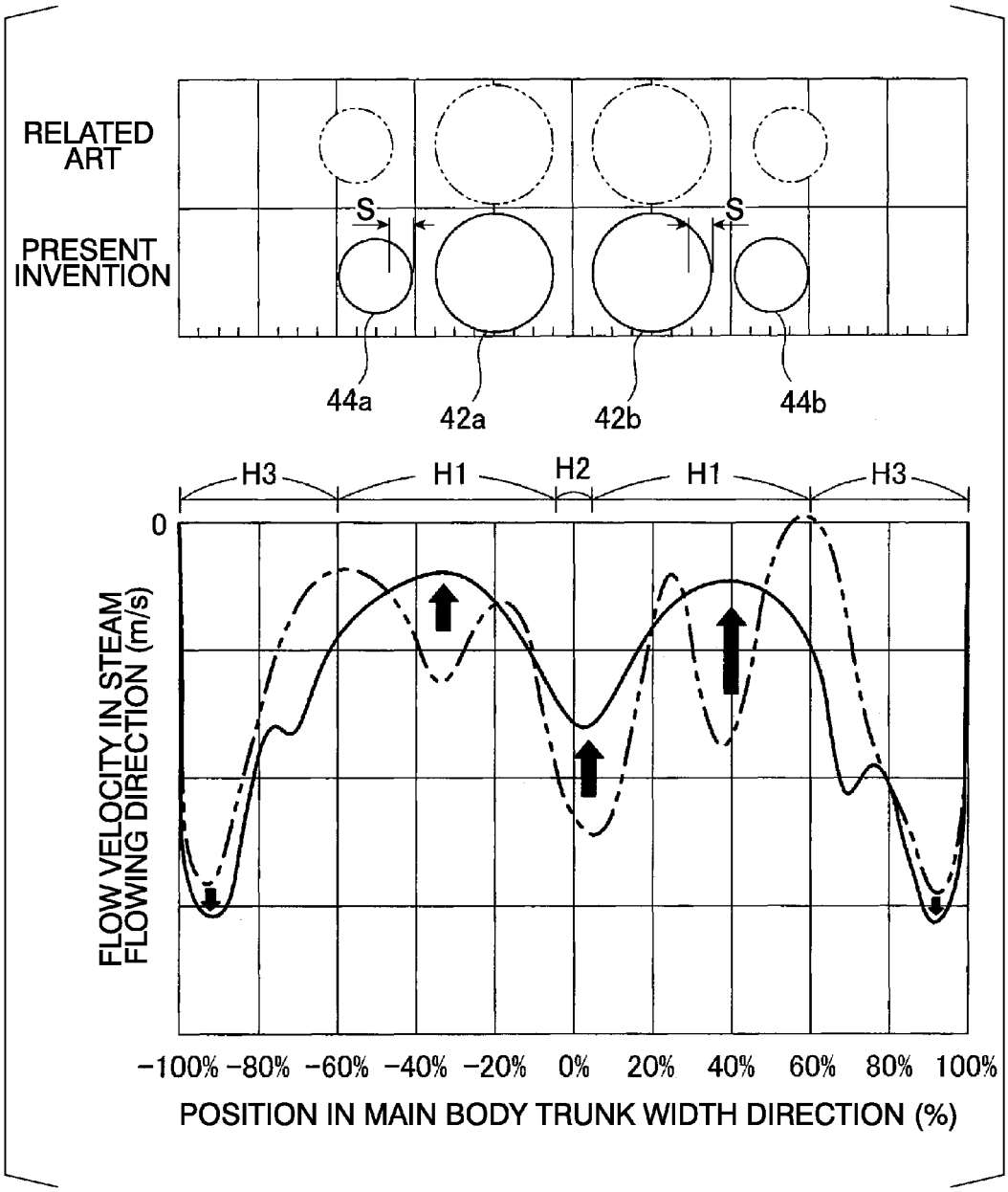
FIG. 2 is a view showing flow velocity distribution of steam at a position II-II in FIG. 1.

An upper part in FIG. 2 shows the installation position of the downstream side heaters 42*a* and 42*b* and the turbine bypass pipes 44*a* and 44*b*. A lower part in FIG. 2 shows the flow velocity of the steam based on the installation position shown in the upper part. Furthermore, in the upper part and the lower part in FIG. 2, a solid line corresponds to the condenser 12 according to the present embodiment, and a two-dot chain line corresponds to the condenser in the related art.

That is, as shown in FIG. 2, in the condenser 12, the gaps S between the downstream side heaters 42*a* and 42*b* and the turbine bypass pipes 44*a* and 44*b* are further decreased as compared to the gaps in the related art. In this manner, the flow velocity distribution of the steam is divided into an interference region H1 where the steam directly interferes with the thin heat transfer pipe group 31 and non-interference regions H2 and H3 where the steam does not directly interfere with the thin heat transfer pipe group 31.

In the interference region H1, the flow velocity is uniformized by reducing the flow velocity of the steam. In this manner, as compared to the flow velocity in the related art, the flow velocity of the steam on the upstream side in the steam flowing direction of the thin heat transfer pipe group 31 can be formed uniformly. Accordingly, the steam can be brought into uniform contact with the thin heat transfer pipe group 31. As a result, it is possible to improve condensation efficiency in the condenser 12. In addition, since the steam flowing at lowered flow velocity comes into contact with the thin heat transfer pipe group 31, it is possible to prevent the thin heat transfer pipe group 31 from being damaged due to the received impact of the steam or droplets.

In addition, the flow velocity of the steam in the non-interference regions H2 and H3 is faster than the flow velocity of the steam in the interference region H1. Accordingly, the steam immediately permeates the surroundings of the thin heat transfer pipe group 31. Therefore, it is possible to further improve the condensation efficiency in the condenser 12.

Second Embodiment

Figure 3:
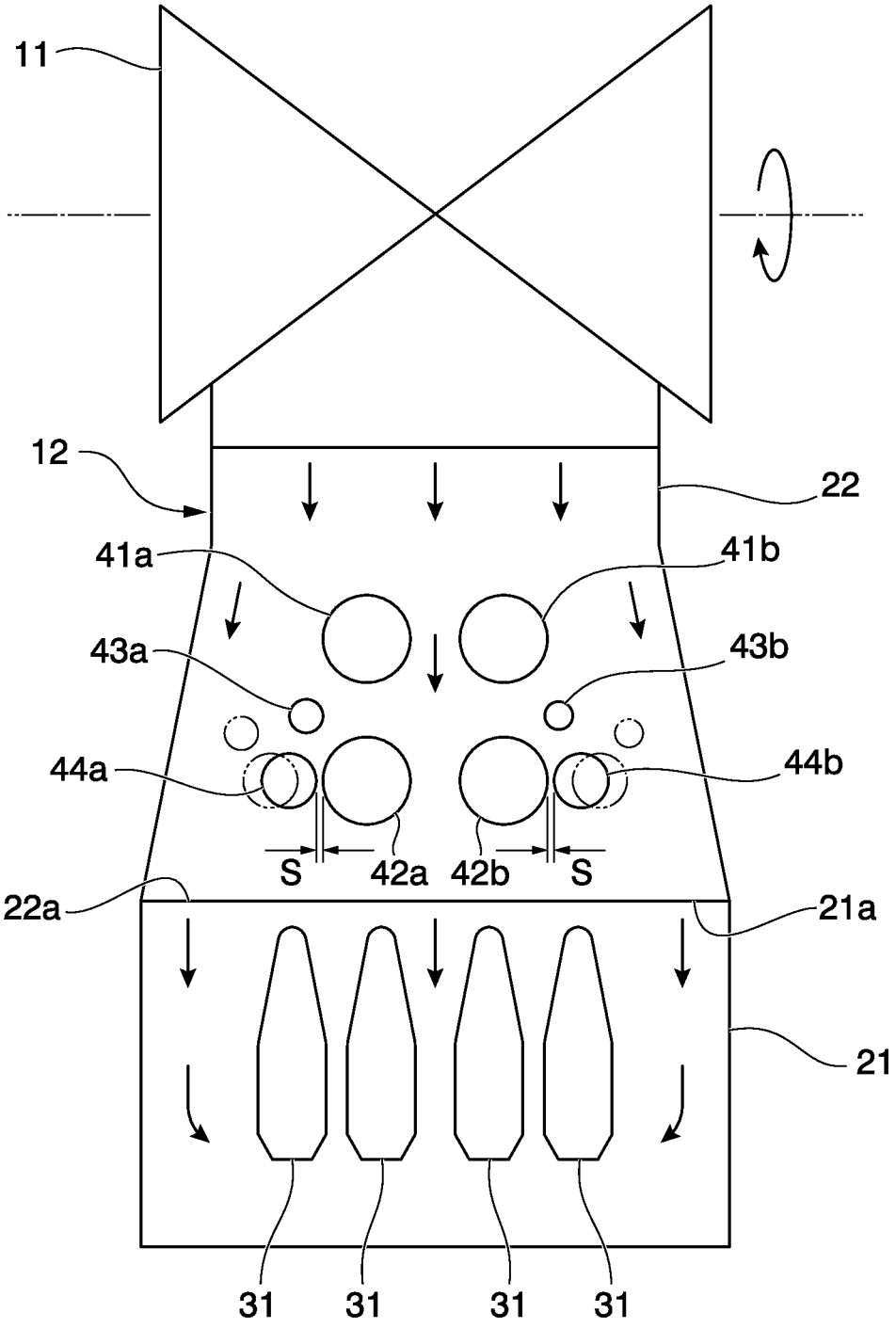
FIG. 3 is a schematic configuration view of a condenser according to a second embodiment of the present invention.

As shown in FIG. 3, in the condenser 12 according to a second embodiment, as compared to the installation position in the related art (position shown by a two-dot chain line in FIG. 3), the installation position of the steam extraction pipes 43*a* and 43*b* is moved inward in the trunk width direction, and is set to be located on the downstream side in the steam flowing direction of the upstream side heaters 41*a* and 41*b*.

That is, the first steam extraction pipe 43*a* is arranged between the first upstream side heater 41*a*, and the first downstream side heater 42*a* and the first turbine bypass pipe 44*a* in the steam flowing direction, and is arranged between the first upstream side heater 41*a* and the first downstream side heater 42*a*, and the first turbine bypass pipe 44*a* in the trunk width direction.

In contrast, the second steam extraction pipe 43*b* is arranged between the second upstream side heater 41*b*, and the second downstream side heater 42*b* and the second turbine bypass pipe 44*b* in the steam flowing direction, and is arranged between the second upstream side heater 41*b* and the second downstream side heater 42*b*, and the second turbine bypass pipe 44*b* in the trunk width direction.

Accordingly, it is possible to decrease the flow velocity of the steam flowing into the condenser 12 by arranging the steam extraction pipes 43*a* and 43*b* in a region on the downstream side (wake) in the steam flowing direction of the upstream side heater 41*b*. Therefore, it is possible to decrease the power loss of the steam.

In addition, the flow rate of the steam flowing along the inner surface of the main body trunk 21 increases as much as the installation position of the steam extraction pipes 43*a* and 43*b* is moved inward in the trunk width direction. Accordingly, a larger amount of the steam can be caused to permeate the surroundings of the thin heat transfer pipe group 31. As a result, it is possible to form a uniform temperature distribution of the steam around the thin heat transfer pipe group 31. Therefore, it is possible to improve heat exchange efficiency of the thin heat transfer pipe group 31.

Third Embodiment

Figure 4:
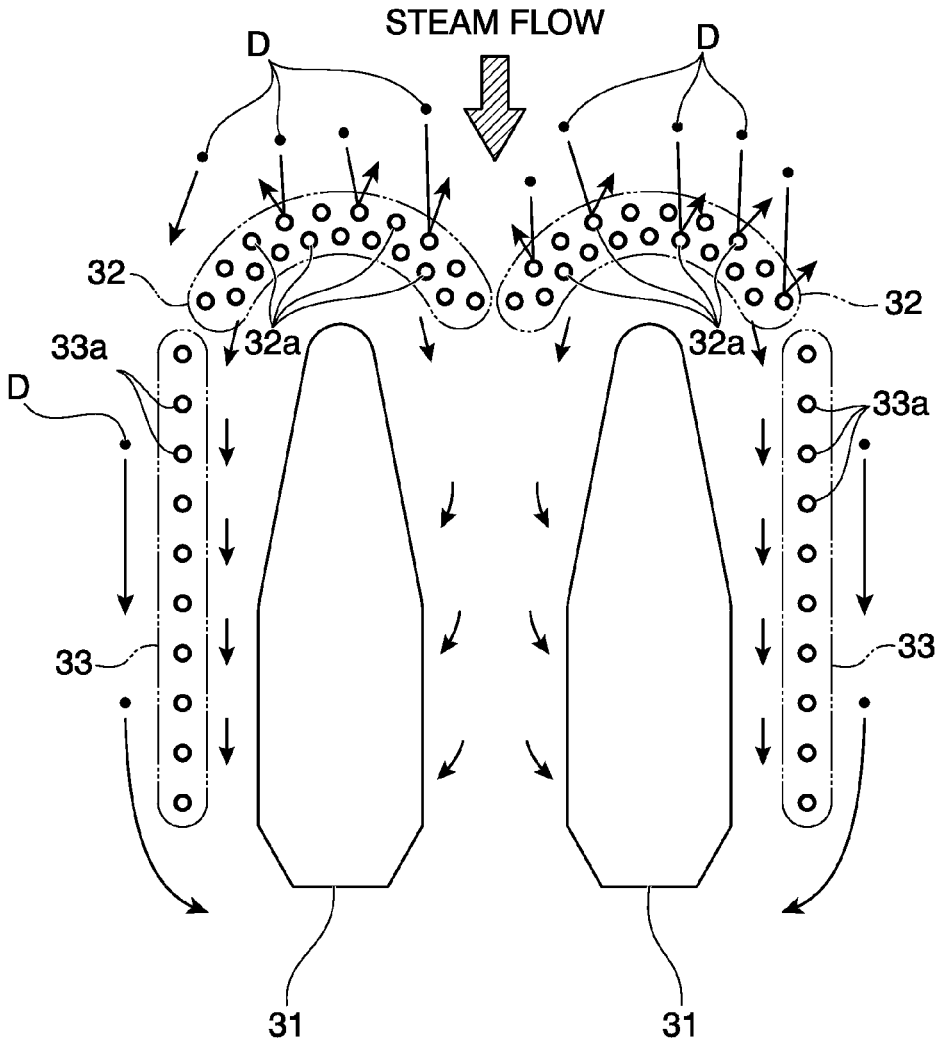
FIG. 4 is a schematic enlarged view around a thin heat transfer pipe group in a condenser according to third and fourth embodiments of the present invention.

As shown in FIG. 4, the condenser 12 according to a third embodiment includes a first cover section 32 inside the main body trunk 21. The first cover section 32 has multiple first communication portions which communicate with the steam flowing direction.

The first cover section 32 is configured so as to extend in the steam flowing direction as the first cover section 32 goes toward both sides in a direction intersecting the steam flowing direction. The first cover section 32 is arranged on the upper end inlet 21*a* side (upstream side in the steam flowing direction) from the thin heat transfer pipe group 31. The first cover section 32 covers the thin heat transfer pipe group 31 along a surface (upstream side surface) on the upper end inlet 21*a* side of the thin heat transfer pipe group 31.

The first cover section 32 is formed from multiple dummy bars 32*a* (bar-shaped steel). A gap between the multiple dummy bars 32*a* serves as the first communication portion.

A shape of the first cover section 32 in a side view (shape shown in FIG. 4) may be an arc shape, a V-shape, or a planar shape. In addition, the first cover section 32 may employ punched metal instead of the multiple dummy bars 32*a*.

In the present embodiment, the first cover section 32 covers the surface on the upper end inlet 21*a* side of the thin heat transfer pipe group 31. Accordingly, even when droplets D contained in a turbine exhaust stream flow into the main body trunk 21 at high flow velocity, it is possible to prevent the droplets D from colliding with the thin heat transfer pipe group 31. As a result, it is possible to prevent the thin heat transfer pipe from being damaged by preventing droplet erosion from occurring.

In addition, the first cover section 32 is arranged on the upper end inlet 21*a* side from the thin heat transfer pipe group 31. Accordingly, the flow of the steam can be straightened by the first communication portions of the first cover section 32. In this manner, it is possible to promote heat exchange between the steam and the thin heat transfer pipe group 31.

Fourth Embodiment

As shown in FIG. 4, the condenser 12 according to a fourth embodiment includes a second cover section 33 inside the main body trunk 21. The second cover section 33 has multiple second communication portions which communicate with the direction intersecting the steam flowing direction.

The second cover section 33 is configured so as to extend in the steam flowing direction from both sides in the direction intersecting the steam flowing direction of the first cover section 32.

The second cover section 33 is formed from multiple dummy bars 33*a* (bar-shaped steel). A gap between the multiple dummy bars 33*a* serves as the second communication portion. Gaps (first communication portions) between the multiple dummy bars 32*a* of the first cover section 32 are arranged more densely than gaps (second communication portions) between the multiple dummy bars 33*a* of the second cover section 33.

A shape of the second cover section 33 in a side view (shape shown in FIG. 4) may be a planar shape or an arc shape. In addition, the second cover section 33 may employ punched metal instead of the multiple dummy bars 33*a*. The dummy bars 33*a* of the second cover section 33 may have the same shape or the same material as the dummy bars 32*a* of the first cover section 32.

As shown in FIG. 4, the second cover section 33 may be arranged on both sides in the trunk width direction of two thin heat transfer pipe groups 31, or may be arranged on both sides in the trunk width direction of one thin heat transfer pipe group 31.

In the present embodiment, the steam (bulk fluid) which passes through the surroundings of the thin heat transfer pipe group 31 and does not come into contact with the surface of the thin heat transfer pipe group is partially separated in the second communication portions of the second cover section 33. The separated fluid is guided to the surface of the thin heat transfer pipe group 31. As described above, the second cover section 33 covers the thin heat transfer pipe group 31 in the steam flowing direction, thereby enabling the steam to flow to the surface of the thin heat transfer pipe group 31. As a result, it is possible to form a temperature gradient around the thin heat transfer pipe group 31. Therefore, it is possible to promote an advantageous effect of transferring heat from the steam to the thin heat transfer pipe group 31.

In addition, the second communication portions of the second cover section 33 are arranged so as to be more sparse than the first communication portions of the first cover section 32, thereby improving a separation effect. Therefore, the steam is enabled to flow into the surface of the thin heat transfer pipe group 31.

Hitherto, the embodiments of the condenser according to the present invention have been described. However, without being limited to the above-described embodiments, the present invention can be appropriately modified within a scope not departing from the gist of the present invention.

Within the scope not departing from the gist of the present invention, the configuration elements in the above-described embodiments can be appropriately replaced with known configuration elements, or the above-described embodiments may be appropriately combined with each other.

INDUSTRIAL APPLICABILITY

The above-described condenser can be applied to a condenser which can obtain a suitable condensation amount according to a flow rate of steam flowing into the condenser.

REFERENCE SIGNS LIST

11 steam turbine
12 condenser

21 main body trunk (bottom section)
21*a* upper end inlet
22 intermediate trunk (trunk section)
22*a* lower end outlet
31 thin heat transfer pipe group (heat transfer pipe)
32 first cover section
32*a* dummy bar
33 second cover section
33*a* dummy bar
41*a* first upstream side heater (upstream side heater)
41*b* second upstream side heater (upstream side heater)
42*a* first downstream side heater (downstream side heater)
42*b* second downstream side heater (downstream side heater)
43*a* first steam extraction pipe (steam extraction pipe)
43*b* second steam extraction pipe (steam extraction pipe)
44*a* first turbine bypass pipe (turbine bypass pipe)
44*b* second turbine bypass pipe (turbine bypass pipe)
S gap
D droplets

The invention claimed is:

1. A condenser which has a heat transfer pipe for circulating a cooling medium, a bottom section for arranging the heat transfer pipe, and a trunk section for communicating with the bottom section, and which generates condensed water by causing steam discharged from a steam turbine to flow into the bottom section from an upper section of the trunk section, by bringing the steam into contact with the heat transfer pipe, and by condensing the steam, the condenser comprising:

a first upstream side heater and a second upstream side heater which are arranged so as to be orthogonal to a steam flowing direction, in the trunk section;

a first downstream side heater and a second downstream side heater which are arranged so as to be located on a downstream side in the steam flowing direction from the first and second upstream side heaters, and so as to be parallel to the first and second upstream side heaters, in the trunk section;

a first turbine bypass pipe and a second turbine bypass pipe which supply the steam bypassing the steam turbine into the trunk section, the first turbine bypass pipe and the second turbine bypass pipe which is arranged so as to be parallel to the first and second upstream side heaters and the first and second downstream side heaters, and by being arranged outside in a trunk width direction of the first and second upstream side heaters and the first and second downstream side heaters, based on the trunk width direction orthogonal to the steam flowing direction, in the trunk section; and a first steam extraction pipe and a second steam extraction pipe which supply the steam to the first and second upstream side heaters and the first and second downstream side heaters by extracting the steam discharged from the steam turbine, the first steam extraction pipe and the second steam extraction pipe which is arranged so as to be parallel to the first and second upstream side heaters and the first and second downstream side heaters, wherein the first downstream side heater and the first turbine bypass pipe are arranged at a same horizontal axis in the steam flowing direction, the length of a gap between the first downstream side heater and the first turbine bypass pipe being set to be equal to or shorter than the radius of the first turbine bypass pipe, and wherein the second downstream side heater and the second turbine bypass pipe are arranged at a same horizontal axis in the steam flowing direction, the length of a gap between the second downstream side heater and the second turbine bypass pipe being set to be equal to or shorter than the radius of the second turbine bypass pipe.

2. The condenser according to claim 1, wherein the first and second steam extraction pipes are arranged outside in the trunk width direction of the first and second turbine bypass pipes.

3. The condenser according to claim 1, wherein the first steam extraction pipe is arranged between the first upstream side heater, and the first downstream side heater and the first turbine bypass pipe in the steam flowing direction, and is arranged between the first upstream side heater and the first downstream side heater, and the first turbine bypass pipe in the trunk width direction, and wherein the second steam extraction pipe is arranged between the second upstream side heater, and the second downstream side heater and the second turbine bypass pipe in the steam flowing direction, and is arranged between the second upstream side heater and the second downstream side heater, and the second turbine bypass pipe in the trunk width direction.

4. The condenser according to claim 1, further comprising:

a first cover section which is arranged inside the bottom section so as to cover the heat transfer pipe from an upstream side in the steam flowing direction, and which has multiple first communication portions communicating with the steam flowing direction.

5. The condenser according to claim 4, further comprising:

a second cover section which is arranged inside the bottom section so as to extend from the first cover section in the steam flowing direction and so as to cover the heat transfer pipe in a direction intersecting the steam flowing direction, and which has multiple second communication portions communicating with the direction intersecting the steam flowing direction.

* * * * *